US009774965B2

(12) United States Patent
Siddhartha et al.

(10) Patent No.: US 9,774,965 B2
(45) Date of Patent: Sep. 26, 2017

(54) METHOD FOR FITTING A HEARING DEVICE AS WELL AS AN ARRANGEMENT FOR FITTING THE HEARING DEVICE

(71) Applicant: SONOVA AG, Staefa (CH)

(72) Inventors: Jha Siddhartha, Adliswil (CH); Ralph Peter Derleth, Hinwii (CH); Silvia Allegro-Baumann, Unterageri (CH); Harald Krueger, Affoltern a. A. (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 15/106,253

(22) PCT Filed: Dec. 18, 2013

(86) PCT No.: PCT/EP2013/077128

§ 371 (c)(1),
(2) Date: Jun. 17, 2016

(87) PCT Pub. No.: WO2015/090381

PCT Pub. Date: Jun. 25, 2015

(65) Prior Publication Data

US 2016/0337769 A1 Nov. 17, 2016

(51) Int. Cl.
*H04R 25/00* (2006.01)

(52) U.S. Cl.
CPC ..... *H04R 25/70* (2013.01); *H04R 25/558* (2013.01); *H04R 25/75* (2013.01); *H04R 25/505* (2013.01);
(Continued)

(58) Field of Classification Search
CPC .... H04R 25/505; H04R 25/558; H04R 25/70; H04R 2225/55
See application file for complete search history.

(56) References Cited

U.S. PATENT DOCUMENTS 6,035,050 A * 3/2000 Weinfurtner ..... H04R 25/507 381/313
9,107,016 B2 * 8/2015 Shennib ..... H04R 25/70
(Continued)

FOREIGN PATENT DOCUMENTS

CH 706 077 7/2013
WO WO-90/09760 9/1990
(Continued)

OTHER PUBLICATIONS

International Search Report and Written Opinion received in International Application No. PCT/US2013/077128, dated Aug. 29, 2014.

*Primary Examiner* — Matthew Eason
(74) *Attorney, Agent, or Firm* — ALG Intellectual Property, LLC

(57) ABSTRACT

An exemplary method for fitting a hearing device to a hearing device user performed by a fitting system operatively connected to but remote from the hearing device includes providing, to the hearing device, an adjustable parameter identified by a fitter using a fitting system and a specification comprising an allowed range for the adjustable parameter defined by the fitter using the fitting system. The method further includes transferring the adjustable parameter and the specification to a user interface operatively connected to the hearing device and located with the hearing device for use by the hearing device user, receiving an adjusted parameter value for the adjustable parameter adjusted by the hearing device user with aid of the user interface to be within the allowed range, and updating the adjustable parameter in a transfer function of the hearing device based on the adjusted parameter value.

20 Claims, 2 Drawing Sheets

(52) U.S. Cl.
CPC ..... *H04R 2225/39* (2013.01); *H04R 2225/55* (2013.01)

(56) References Cited

U.S. PATENT DOCUMENTS

| | | | | |
|---|---|---|---|---|
| 9,439,008 | B2 * | 9/2016 | Shennib | H04R 25/70 |
| 2004/0028250 | A1 * | 2/2004 | Shim | H04R 25/70 381/312 |
| 2005/0283263 | A1 * | 12/2005 | Eaton | H04R 25/554 700/94 |
| 2006/0153395 | A1 * | 7/2006 | van Den Heuvel | A61N 1/36032 381/60 |
| 2007/0076909 | A1 * | 4/2007 | Roeck | H04R 25/70 381/312 |
| 2009/0060214 | A1 | 3/2009 | Wessel et al. | |
| 2009/0154741 | A1 * | 6/2009 | Woods | H04R 25/70 381/312 |
| 2010/0202637 | A1 * | 8/2010 | Cornelisse | H04R 25/70 381/314 |
| 2010/0205447 | A1 * | 8/2010 | Waldmann | H04R 25/70 713/182 |
| 2011/0044483 | A1 | 2/2011 | Edgar | |
| 2011/0051963 | A1 | 3/2011 | Barthel et al. | |
| 2011/0176686 | A1 * | 7/2011 | Zaccaria | H04R 25/70 381/60 |
| 2012/0070023 | A1 * | 3/2012 | Nishizaki | A61B 5/121 381/314 |
| 2013/0177188 | A1 * | 7/2013 | Apfel | H04R 25/558 381/315 |
| 2013/0243227 | A1 * | 9/2013 | Kinsbergen | H04M 1/2475 381/314 |
| 2014/0309549 | A1 * | 10/2014 | Selig | H04R 1/1041 600/559 |
| 2017/0064470 | A1 * | 3/2017 | Popovac | H04R 25/558 |

FOREIGN PATENT DOCUMENTS

| | | |
|---|---|---|
| WO | WO-2008/025858 | 3/2008 |
| WO | WO-2009/103823 | 8/2009 |
| WO | WO-2012/107085 | 8/2012 |

* cited by examiner

METHOD FOR FITTING A HEARING DEVICE AS WELL AS AN ARRANGEMENT FOR FITTING THE HEARING DEVICE

FIELD OF THE INVENTION

The present invention is related to a method for fitting at least one hearing device as well as to an arrangement for fitting at least one hearing device.

BACKGROUND OF THE INVENTION

Fitting a hearing device is a process of adjusting parameters in a hearing device in accordance with individual needs of a hearing device user. Conventionally, a hearing care professional—also called fitter—adjusts the parameters of the hearing device based on the individual audiogram and a so called fitting formula or prescription. If the user reports problems, particular parameters may be fine-tuned by the fitter. Only basic parameters such as volume and hearing program are normally adjusted by the user him- or herself, and usually at runtime and not during fitting. The fitting process is normally carried out in the fitter's office or practice.

In a conventional fitting of a hearing device, the fitter interrogates the hearing device user and changes the parameters of the hearing device according to the user's feedback. However, the observations of the fitter and his ensuing estimations of what the user perceives are imprecise, and the resulting parameter settings are usually suboptimal.

Furthermore, the fitting process is usually carried out locally, i.e. the hearing care professional and the hearing device user join together at the same physical location. Such face-to-face fitting sessions are however not always possible, e.g. when a hearing device user lives very far from the hearing care professional's practice, or when a hearing device user is immobile.

States of the art reflecting known teachings in the field are, for example, U.S. 2009/060214 A1, WO 2012/107085 al, U.S. 2011/044483 A1, CH 706 077 A2 and WO 2008/025858 A1.

It is therefore an object of the present invention to provide a method for fitting a hearing device or a binaural hearing device, which method does at least not have one of the drawbacks mentioned above.

SUMMARY OF THE INVENTION

Throughout this description, the term "hearing device" means a single hearing device as well as a pair of hearing devices. The pair of hearing devices may than operate as a binaural hearing system. A hearing device may be used to improve the hearing of a hearing impaired person or to compensate a hearing loss as well as to improve communication in general, i.e. also between normal hearing people. Furthermore, a hearing device as described herein may also be an ear protection device that is used to protect a user from loud noise. In particular for musicians, a well fitted ear protection device is important in order that the musician may still perceive sounds undistorted and in all details. Finally, a hearing device may be of any type, such as a BTE—(Behind the ear), CIC—(Completely in the Canal), ITC—(in the canal) or may even be an implantable device.

The present invention is first directed to a method for fitting a hearing device that is at least partially inserted into an ear of a hearing device user and that has a transfer function defined by parameters and its values, the method comprises the steps of:

operatively connecting a fitting system and the hearing device via a connection, a) defining adjustable parameters in the fitting system, the adjustable parameters being all parameters or a subset of the parameters, b) defining specifications for the adjustable parameters in the fitting system, the specifications comprising at least one of:

starting value/s for the adjustable parameter/s, allowed range/s for the adjustable parameter/s, c) transferring the parameters and the specifications via the connection to the hearing device or to a user interface that is operatively connected to the hearing device, d) adjusting at least some of the values for the adjustable parameters within its specifications with the aid of the user interface, e) transmitting the adjustments made to the adjustable parameter values to the fitting system, f) updating the adjustable parameters in the transfer function by taking into account the adjusted parameter values, g) repeating at least one of the steps a) to f) if further adjustments to the transfer function are necessary, terminating the connection between the fitting system and the hearing device if no further adjustments to the transfer function are necessary, wherein adjusting is temporarily changing a value of an adjustable parameter, updating is permanently storing the adjusted value of an adjustable parameter, and updating is controlled by the fitting system, thus preventing an permanent change of parameters without support by a hearing healthcare professional.

The method according to the present invention is very well suitable for remote fitting and therefore has the advantage that the user can select of a higher number of hearing care professionals. The interaction between fitter and user in collaborative fitting and in particular the active involvement of the user in adjusting even complex parameter sets allows to achieve an optimum individual fitting with minimum efforts and much shorter "feedback-loop" between fitter and user. As a result, the fitting is faster, the resulting settings are better, and both user and fitter are more satisfied than in conventional "interrogate and adjust" fittings. Furthermore, the fitter has full control over the fitting workflow and can support and assist the user.

Finally, the proposed "collaborative" or "user-assisted" fitting is very well suited for a remote setup because both user and fitter, each one at his site, can carry out major parts of their tasks independently from the other. Interaction takes place on a high level and not about details (e.g. about an intermediate optimum tuning determined by the user and not about step-wise adjustment of a particular parameter). Nevertheless, online communication is guaranteed and support and control of the professional is possible at any time.

An embodiment of the method according the present invention further comprises steps in-between steps a) and g), namely:

defining an adjustment task in the fitting system, transmitting the adjustment task to the hearing device or the user interface and informing the user of the adjustment task.

Knowledge of an adjustment task may enable the user to focus on specific sound impressions. Unnecessary information or impressions can be ignored.

Further embodiments of the method according to the present invention further comprise steps in-between steps a) and g), namely:

defining a sound environment in the fitting system, transmitting information reflecting the defined sound environment to the user interface, activating a sound system in the vicinity of the user (1) to create the sound environment defined in the fitting system.

The further steps open up the possibility to create sound sceneries that simulate predefined acoustic situations in which the parameters must be adjusted.

In further embodiments of the method according to the present invention, the step of updating the parameters in the transfer function and the step of transmitting the adjustments made to the adjustable parameter values to the fitting system are performed in real-time.

In a real-time processing, the fitter can follow the adjustments of parameter and take over control immediately, if necessary.

Further embodiments of the method according to the present invention further comprise the steps of:

adjusting at least some of the values for the adjustable parameters in the fitting system and transmitting the adjustments made to the adjustable parameter values to the hearing device or to the user interface.

In further embodiments of the method according to the present invention, the adjustable parameters comprise at least one of:

volume, left/right balance, tonal balance, hearing program, a frequency compression parameter, a parameter related to a tinnitus masking signal.

In still further embodiments of the method according to the present invention, at least two of the parameters are adjustable parameters.

In further embodiments of the method according to the present invention, the allowed range for the adjustable parameter is limited such that no detrimental settings are possible in the at least one hearing device.

In further embodiments of the method according to the present invention, the connection is a remote connection and in case of an interruption of the connection between the hearing device and the fitting system the adjusting of the hearing device parameters is cancelled in order to return to the last stored setting. This avoids leaving the hearing device in an undefined state or with settings, which have not been approved by a professional.

The present invention is also directed to an arrangement for fitting a hearing device that is at least partially inserted into an ear of a hearing device user and that has a transfer function defined by parameters and its values. The arrangement according to the present invention comprises:

the hearing device, a user interface, a fitting system, a connection for operatively connecting the fitting system and the hearing device, adjustable parameters defined in the fitting system, the adjustable parameters being all parameters or a subset of the parameters, specifications defined for the adjustable parameters in the fitting system, the specifications comprising at least one of:

starting value/s for the adjustable parameter/s, allowed range/s for the adjustable parameter/s, means adapted for transferring the parameters and the specifications via the connection to the hearing device or to the user interface that is operatively connected to the hearing device, means adapted for adjusting at least some of the values for the adjustable parameters within its specifications with the aid of the user interface, means adapted for transmitting the adjustments made to the adjustable parameter values to the fitting system, means adapted for updating the adjustable parameters in the transfer function by taking into account the adjusted parameter values.

An embodiment of the arrangement according to the present invention further comprises:

means adapted for defining an adjustment task in the fitting system, means adapted for transmitting the adjustment task to the hearing device or the user interface and means adapted for informing the user of the adjustment task.

Further embodiments of the arrangement according to the present invention further comprise:

means adapted for defining a sound environment in the fitting system, means adapted for transmitting information reflecting the defined sound environment to the user interface, means for activating a sound system in the vicinity of the user to create the sound environment defined in the fitting system.

Still further embodiments of the arrangement according to the present invention further comprise:

means adapted for adjusting at least some of the values for the adjustable parameters in the fitting system and means adapted for transmitting the adjustments made to the adjustable parameter values to the hearing device or to the user interface.

In further embodiments of the arrangement according to the present invention, the adjustable parameters comprise at least one of:

volume, left/right balance, tonal balance, hearing program, a frequency compression parameter, a parameter related to a tinnitus masking signal.

In still further embodiments of the arrangement according to the present invention, at least two of the parameters are adjustable parameters and are controlled simultaneously by the user. This is particularly important if the user interface allows multidimensional inputs. An example for such a user interface is a touch screen for 2-dimensional inputs. A further example is a user interface based on gestures. The user input might be a meta-parameter or a macro-parameter which maps a one or more dimensional gesture or a movement to a set of low level parameters.

In still further embodiments of the arrangement according to the present invention, the allowed range for the adjustable parameter is limited such that no detrimental settings are possible in the at least one hearing device.

It is pointed out that any combination of the above-mentioned embodiments is possible. Only those embodiments or combinations of embodiments are excluded that would result in a contradiction.

BRIEF DESCRIPTION OF THE DRAWINGS

The present invention is further described by referring to drawings showing exemplified embodiments of the present invention.

DETAILED DESCRIPTION OF THE PRESENT INVENTION

Figure 1:
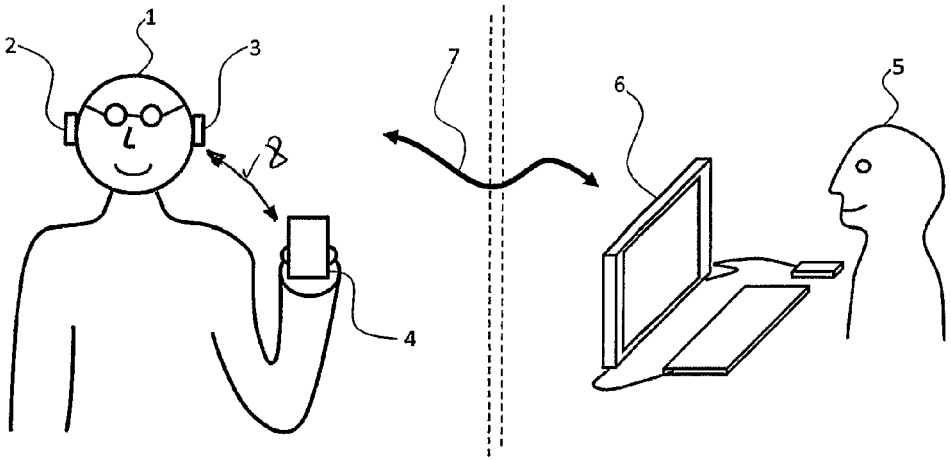
FIG. 1 schematically shows an inventive arrangement for fitting a hearing device worn by a user and FIG. 2 shows a flow chart of an embodiment of a method according to the present invention.

FIG. 1 schematically shows an arrangement for fitting two hearing devices 2, 3 being part of a binaural hearing system that is worn by a user 1. As the term "hearing device" is defined as being one or two devices, the singular form is used in the following detailed description even though FIG. 1 shows two devices 2 and 3.

The hearing device 2, 3 is connectable to a user interface 4 via an interconnection 8. The user interface 4 has input and display capabilities and is designed to be operate-able by the user 1, e.g. the user interface 4 is adapted to the needs of patients having no particular computer skills. The user interface 4 may, in a particular embodiment of the present invention, very well be a touch pad device or a gesture-controlled device. A wide variety of devices are readily available in the art. In particular, the user interface 4 may be a remote control, any hearing device accessory, such as a streaming device, a smart phone, a music-player, an E-Book Reader or a general electronic device, a wii console or any internet television set.

The interconnection 8 may be a wired or a wireless connection, the latter being based, for example, on a standard such as Bluetooth. Other embodiments may use RF—(Radio Frequency), HIBAN being based on magnetic induction, IR—(Infra Red), Sound or DTMF.

A hearing care professional, hereinafter called fitter 5, controls a fitting system 6, e.g. a personal computer with dedicated software. The fitting system 6 may be connected via a connection 7 to the hearing device 2, 3 and/or to the user interface 4. The connection 7 is a bi-directional fast communication link, e.g. based on TCP/IP protocol as the World Wide Web.

While the fitting system 6 is at the fitter's location, the user interface 4 is at the user's location. In general, these physical locations are far away from each other. It is therefore that the connection is called remote connection and the fitting setup is called remote setup. However, the arrangement according to the present invention may very well be operated if the locations of the user 1 and the fitter 5 are rather close, e.g. only separated by a wall. In fact, the arrangement according to the invention may also be operated if the user 1 and the fitter 5 are in the same room. This so called "in-the-office" fitting may be used for a first time instruction of the user 1 by the fitter 5, e.g. for handing over the hearing device 2, 3 and/or the user interface 4 as well as for introducing the collaborative fitting according to the present invention to the user. However, a typical use of the arrangement according to the present invention clearly is the remote setup.

In the remote setup, as already mentioned above, the user 1 of the hearing device 1, 2 and the fitter 5 are not at the same physical location during the fitting process. To allow communication between the user 1 and the fitter 5 during the remote fitting session, and to provide suitable sound environments at the location of the hearing device user 1, the connection 7 is established and preserved during the entire fitting process.

The method for fitting the hearing device 2, 3 is carried out in a collaborative way between the fitter 5 and the user 1. Thereby, the user 1 wears his hearing device 2, 3 and the fitter 5 selects a parameter or several parameters to be adjusted. These so called adjustable parameters are given a starting value and/or an allowed range within not only the starting value but any given value later on must be. The fitter 5 defines the adjustable parameters, starting values and/or allowed range via an input unit of the fitting system 6. These definitions are sent via the connection 7 to the hearing device 2, 3 and/or to the user interface 4 and are immediately effective or after a predefined delay.

The user 1 may then adjust the adjustable parameter(s) on his user interface 4. Again, the further amended values for the adjustable parameters are effective immediately on the hearing device 2, 3 of the user 1 and preferably at the same time—or with just a short delay—visible for the fitter 5 on a display unit of the fitting system 6. The fitter 5 may supervise the parameter adjustments of the user 1 at any time and provides support via the connection 7. In case of an interruption of the connection 7 the settings, i.e. the values for the adjustable parameters, are restored by loading the last saved values. In such a situation, the user 1 or the fitter 5 must again setup the connection 7 to continue the fitting process.

The method for fitting the hearing device 2, 3 is further explained in connection with a flow chart depicted in FIG. 2.

Figure 2:
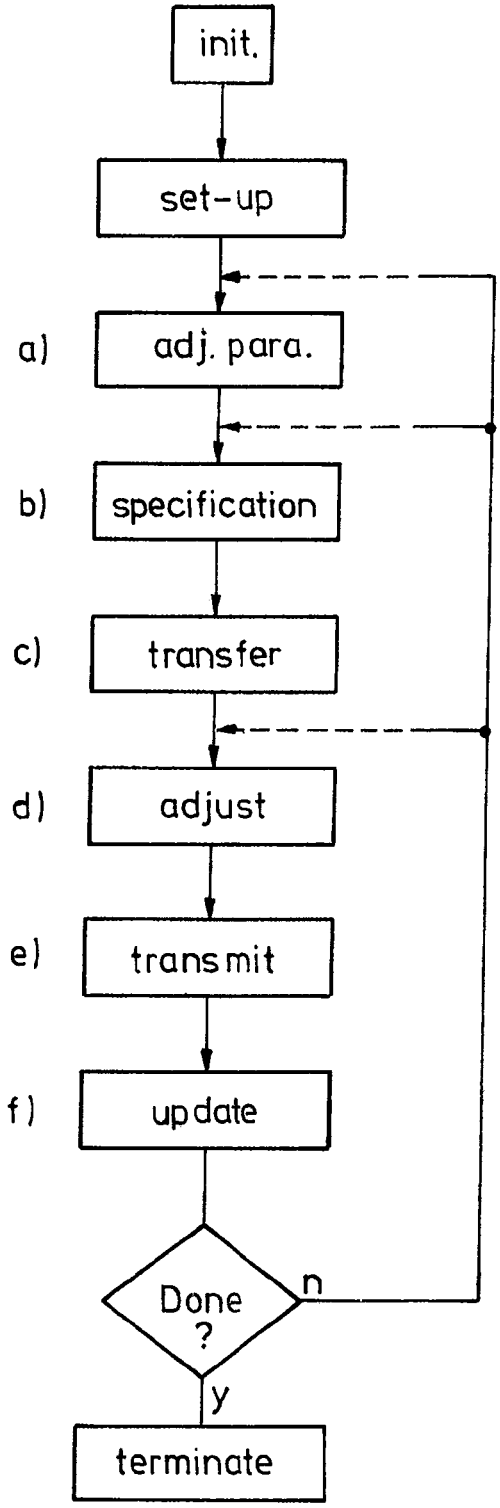

The flow chart of FIG. 2 starts with an initialization that is usually triggered by the fitter 5 (FIG. 1) but may also be triggered by the user 1 (FIG. 1) of the hearing device 2, 3.

After initialization, the step of setting up a connection 7 between the fitting system 6 and the hearing device 2, 3 and/or the user interface 4.

Once the desired connection 7 is built up, the steps a) to f) representing one embodiment of the method according to the present invention can be carried out.

In step a), adjustable parameters are defined in the fitting system 6 (FIG. 1). The adjustable parameters can be all parameters of the transfer function defining the behavior of the hearing device 2, 3 or can be a subset of the parameter of the transfer function.

In step b), specifications are defined for the adjustable parameters. The specifications comprise at least one of:

starting value/s for the adjustable parameter/s, allowed range/s for the adjustable parameter/s, The starting values for the adjustable parameters are a first guess of the parameter values by the fitter 5 based on his general knowledge and information of the user 1, in particular of his or her audiogram. In a follow-up fitting session, where the parameters are fine-tuned, the starting values could be the actual settings of the hearing device.

The allowed ranges for the adjustable parameters are the ranges, within a corresponding adjustable parameter may be adjusted by the user 1. The adjustment by the user 1 is made via the user interface 4.

The starting values and the allowed ranges for the adjustable parameters may also be fully or partially determined automatically based on the audiogram of the user.

In step c), the parameters and the specifications are transferred to the hearing device 2, 3 or to the user interface 4. It is pointed out that in one embodiment of the present invention only adjustable parameters and its specifications are transferred to the hearing device 2, 3 or the user interface 4. In another embodiment of the present invention all parameters of the transfer function are transferred. This may be done in cases where the fitter 5 decides that another transfer function having another set of parameters must be used.

In step d), the user 1 takes influence directly on the fitting process in that he or she adjusts at least some of the values of the adjustable parameters with the aid of the user interface 4. The adjustments made to the adjustable parameters must be within the specifications the fitter 5 has provided.

In step e), the adjustments of the adjustable parameter values are transmitted to the fitting system 6 in order to allow the fitter 5 to follow up the adjustments made by the user 1. Therewith, the fitter 5 is up to date of any changes to the hearing device settings and may give advice immediately once the user 1 is not able to handle the adjustments. Furthermore, the fitter 5 may give further information as to how the transfer function will be influenced by adjusting a specific parameter. In addition, the fitter 5 may inform the user 1 of the sequence of parameter adjustments in order to obtain best results.

In step f), the adjustable parameters that have been updated by the user 1 and have been sent to the fitting system 6 are transferred to the hearing device 2, 3 in order that the adjustments immediately become effective. It is pointed out that the steps d) and e) may be carried out at the same time or that step e) is carried out before step d).

After the steps a) to f) have been carried out further adjustments to the transfer functions may be necessary because the user 1 and/or the fitter 5 came to the conclusion that an optimal adjustment has not been reached yet. In this case some or all of the steps a) to f) may be repeated in order to reach a still better setting.

In a further embodiment of the present invention, an adjustment task is defined in the fitting system 6 by the fitter 5. The adjustment task is transmitted to the hearing device 2, 3 or to the user interface 4. The user is informed what kind of adjustments task will be dealt with. For example, adjustment tasks may be:

maximize intelligibility;

maximize pleasantness;

adjust such that a particular sound is just barely audible.

With this information, it is easier for the user to focus and to adjust only specified parameters. Again, the fitter 5 may guide the user 1 in addition to reach fast results.

Furthermore, a sound environment can be determined or specified in the fitting system 6. Information reflecting the determined sound environment is transmitted to the user interface 4 that may activate a sound system in the vicinity of the user to create the specified sound environment. The sounds presented during the adjustment may be any of the following:

the fitter speaking;

the user speaking;

recorded life scenes, such as traffic, concert, church, nature, birds or similar;

artificial stimuli, such as pure tones, noise, wobble tones;

a combination of recorded life scenes and/or other stimuli (sound parcours);

an ISTS—(International Speech Test Signal).

The parameter to be adjusted may be one of the following:

volume, left/right balance, tonal balance, hearing program, a frequency compression parameter, a parameter related to a tinnitus masking signal.

The invention claimed is:

1. A method comprising:

providing, by a fitting system operatively connected via a connection to a hearing device that is at least partially inserted into an ear of a hearing device user, an adjustable parameter to the hearing device, the adjustable parameter identified by a fitter using the fitting system while the fitting system is located remotely from the hearing device, the hearing device including a transfer function defined by one or more parameters including the adjustable parameter;

providing, by the fitting system to the hearing device, a specification for the adjustable parameter, the specification defined by the fitter using the fitting system while the fitting system is located remotely from the hearing device and comprising an allowed range for the adjustable parameter;

transferring, by the fitting system via the connection and to a user interface operatively connected to the hearing device and located with the hearing device for use by the hearing device user, the one or more parameters and the specification defined by the fitter that comprises the allowed range for the adjustable parameter;

receiving, by the fitting system via the connection and from the user interface, an adjusted parameter value for the adjustable parameter, the adjusted parameter value adjusted by the hearing device user with aid of the user interface to be within the allowed range for the adjustable parameter comprised in the specification defined by the fitter; and updating, by the fitting system in response to the receiving of the adjusted parameter value from the user interface, the adjustable parameter in the transfer function based on the adjusted parameter value.

2. The method of claim 1, further comprising:

defining, by the fitting system, an adjustment task; and transmitting, by the fitting system, the adjustment task to the user interface to inform the user of the adjustment task.

3. The method of claim 1, further comprising:

defining, by the fitting system, a sound environment; and transmitting, by the fitting system, information representative of the defined sound environment to the user interface to activate a sound system in a vicinity of the hearing device user to create the sound environment defined by the fitting system.

4. The method of claim 1, wherein the receiving of the adjusted parameter value and the updating of the adjustable parameter in the transfer function are performed in real-time.

5. The method of claim 1, further comprising:

adjusting, by the fitting system, a second adjustable parameter value of a second adjustable parameter within the one or more parameters; and transmitting, by the fitting system to the user interface, the second adjustable parameter value of the second adjustable parameter.

6. The method of claim 1, wherein the adjustable parameter comprises at least one of a volume parameter, a left/right balance parameter, a tonal balance parameter, a hearing program, a frequency compression parameter, and a parameter related to a tinnitus masking signal.

7. The method of claim 1, wherein at least two of the one or more parameters are adjustable parameters.

8. The method of claim 1, wherein the allowed range for the adjustable parameter is limited such that no detrimental settings are possible in the hearing device.

9. The method of claim 1, wherein the adjustable parameter is restored to a last saved value if the connection is interrupted.

10. A fitting system operatively connected via a connection to a hearing device that is at least partially inserted into an ear of a hearing device user, the fitting system comprising:

at least one physical computing device that provides an adjustable parameter to the hearing device, the adjustable parameter identified by a fitter using the fitting system while the fitting system is located remotely from the hearing device, the hearing device including a transfer function defined by one or more parameters including the adjustable parameter;

provides, to the hearing device, a specification for the adjustable parameter, the specification defined by the fitter using the fitting system while the fitting system is located remotely from the hearing device and comprising an allowed range for the adjustable parameter;

transfers, via the connection to a user interface operatively connected to the hearing device and located with the hearing device for use by the hearing device user, the one or more parameters and the specification defined by the fitter that comprises the allowed range for the adjustable parameter;

receives, via the connection from the user interface, an adjusted parameter value for the adjustable parameter, the adjusted parameter value adjusted by the hearing device user with aid of the user interface to be within the allowed range for the adjustable parameter comprised in the specification defined by the fitter; and updates, in response to the receipt of the adjusted parameter value from the user interface, the adjustable parameter in the transfer function based on the adjusted parameter value.

11. The fitting system of claim 10, wherein the at least one physical computing device further:

defines an adjustment task in the fitting system; and transmits the adjustment task to the user interface to inform the hearing device user of the adjustment task.

12. The fitting system of claim 10, wherein the at least one physical computing device further:

defines a sound environment; and transmits information representative of the defined sound environment to the user interface to activate a sound system in a vicinity of the hearing device user to create the sound environment.

13. The fitting system of claim 10, wherein the at least one physical computing device further:

adjusts a second adjustable parameter value of a second adjustable parameter within the one or more parameters; and transmits, to the user interface, the second adjustable parameter value of the second adjustable parameter.

14. The fitting system of claim 10, wherein the adjustable parameter comprises at least one of a volume parameter, a left/right balance parameter, a tonal balance parameter, a hearing program, a frequency compression parameter, and a parameter related to a tinnitus masking signal.

15. The fitting system of claim 10, wherein the user interface is configured to facilitate the hearing device user in adjusting at least two adjustable parameters of the one or more parameters simultaneously.

16. The fitting system of claim 10, wherein the at least one physical computing device receives the adjusted parameter value and updates the adjustable parameter in the transfer function in real-time.

17. A non-transitory computer-readable medium comprising computer-executable instructions configured to cause at least one physical computing device to:

provide an adjustable parameter to a hearing device that is at least partially inserted into an ear of a hearing device user, the adjustable parameter identified by a fitter using a fitting system that is operatively connected to the hearing device via a connection while the fitting system is located remotely from the hearing device, the hearing device including a transfer function defined by one or more parameters including the adjustable parameter;

provide, to the hearing device, a specification for the adjustable parameter, the specification defined by the fitter using the fitting system while the fitting system is located remotely from the hearing device and comprising an allowed range for the adjustable parameter;

transfer, via the connection to a user interface operatively connected to the hearing device and located with the hearing device for use by the hearing device user, the one or more parameters and the specification defined by the fitter that comprises the allowed range for the adjustable parameter;

receive, via the connection from the user interface, an adjusted parameter value for the adjustable parameter, the adjusted parameter value adjusted by the hearing device user with aid of the user interface to be within the allowed range for the adjustable parameter comprised in the specification defined by the fitter; and update, in response to the receipt of the adjusted parameter value from the user interface, the adjustable parameter in the transfer function based on the adjusted parameter value.

18. The non-transitory computer-readable medium of claim 17, wherein the computer-executable instructions are further configured to cause the at least one physical computing device to:

define an adjustment task; and transmit the adjustment task to the user interface to inform the hearing device user of the adjustment task.

19. The non-transitory computer-readable medium of claim 17, wherein the computer-executable instructions are further configured to cause the at least one physical computing device to:

define a sound environment; and transmit information representative of the defined sound environment to the user interface to activate a sound system in a vicinity of the hearing device user to create the sound environment defined by the at least one physical computing device.

20. The non-transitory computer-readable medium of claim 17, wherein the computer-executable instructions are configured to cause the at least one physical computing device to receive the adjusted parameter value and update the adjustable parameter in the transfer function in real-time.

* * * * *